US006651447B1

(12) United States Patent
Riedesel

(10) Patent No.: US 6,651,447 B1
(45) Date of Patent: Nov. 25, 2003

(54) METHOD FOR FORMING ICE SCULPTURES

(76) Inventor: Darrell L. Riedesel, 517 James St., Hinton, WV (US) 25951

( * ) Notice: Subject to any disclaimer, the term of this patent is extended or adjusted under 35 U.S.C. 154(b) by 0 days.

(21) Appl. No.: 10/307,846

(22) Filed: Dec. 3, 2002

(51) Int. Cl.[7] ..... F25C 1/04
(52) U.S. Cl. ..... 62/66; 62/1; 62/264
(58) Field of Search ..... 62/1, 66, 264, 62/340; 249/142

(56) References Cited

U.S. PATENT DOCUMENTS 3,060,494 A 10/1962 Noble
4,351,157 A 9/1982 Zeigler
D292,802 S 11/1987 Fails
4,807,844 A 2/1989 Tu
4,817,911 A 4/1989 Infanti
4,974,809 A 12/1990 Lipke et al.
D348,473 S 7/1994 Griffin, Sr.
6,289,683 B1 9/2001 Daukas et al.

*Primary Examiner*—William E. Tapolcai
(74) *Attorney, Agent, or Firm*—Donald R. Schoonover

(57) ABSTRACT

An ice sculpture is formed using a temporary mold that has been formed of plastic or rubber like material. Liquid, such as water, is poured into the temporary mold and the liquid-containing temporary mold is then frozen to form the desired shape. The temporary mold is then broken away from the desired shape and is discarded. An area which accommodates an electric light can be included in the desired shape.

3 Claims, 2 Drawing Sheets

METHOD FOR FORMING ICE SCULPTURES

BACKGROUND OF THE INVENTION

1. Field of the Invention

The present invention relates to the general art of static molds, and to the particular field of molding processes using static molds.

2. Discussion of the Related Art

Many people enjoy displaying theme-related items. These items can be related to a holiday, such as Christmas, or a party theme. The items range from statues to candles and food items.

Ice sculptures are popular forms of this type of display item. Ice sculptures are often displayed at parties to enhance the theme of the party. Ice sculptures can be expensive to form and thus there are only limited variations of ice sculptures available. Birds and the like are common examples of ice sculptures that are available. However, these sculptures may not be relevant to certain themes. In some instances, a theme may be dictated or influenced by the ice sculptures that are available to the planners. In other instances, the ice sculpture is so generic that it adds little or nothing to the overall theme. Holiday themes are particularly susceptible to this drawback.

Therefore, there is a need for a method of forming sculptures, such as ice sculptures, which is easy and inexpensive.

PRINCIPAL OBJECTS OF THE INVENTION

It is a main object of the present invention to provide a method of forming sculptures which is easy and inexpensive.

It is another object of the present invention to provide a method of forming sculptures, such as ice sculptures, which is easy and inexpensive.

SUMMARY OF THE INVENTION

These, and other, objects are achieved by a method that includes providing a re-usable metal form and forming temporary plastic or rubber like molds in the metal mold. Freezable liquid, such as water, is placed in the temporary mold and then frozen. Once the liquid is frozen, the temporary mold is broken away from the frozen liquid and is discarded. An electric light can be placed in the form defined when the liquid freezes for display purposes.

The temporary molds are easy to use and are inexpensive. Thus numerous different molds can be supplied whereby various themes can be supported.

BRIEF DESCRIPTION OF THE DRAWING FIGURES

DETAILED DESCRIPTION OF THE PREFERRED EMBODIMENT

Other objects, features and advantages of the invention will become apparent from a consideration of the following detailed description and the accompanying drawings.

Figure 2:
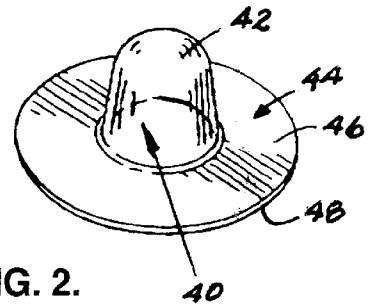
FIG. 2 is a perspective view of an insert that is used to house a light in the ice sculpture shown in FIG. 1.
Figure 3:
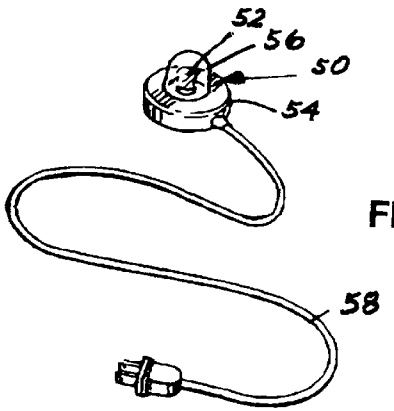
FIG. 3 is a perspective view of a light that can be used in conjunction with the ice sculpture shown in FIG. 1.
Figure 1:
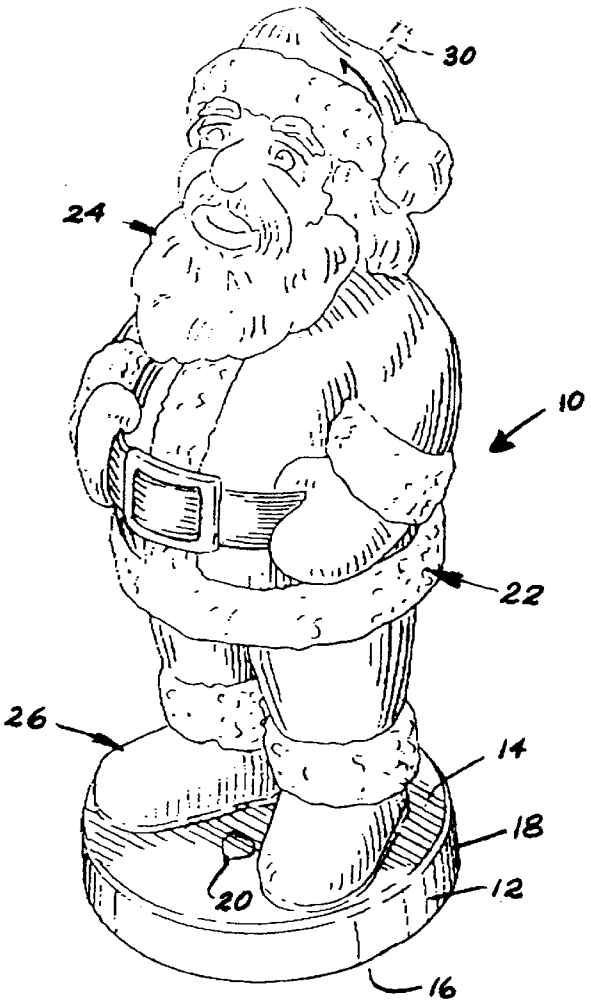
FIG. 1 is a perspective view of an ice sculpture formed in accordance with the method embodying the present invention.
Figure 4:
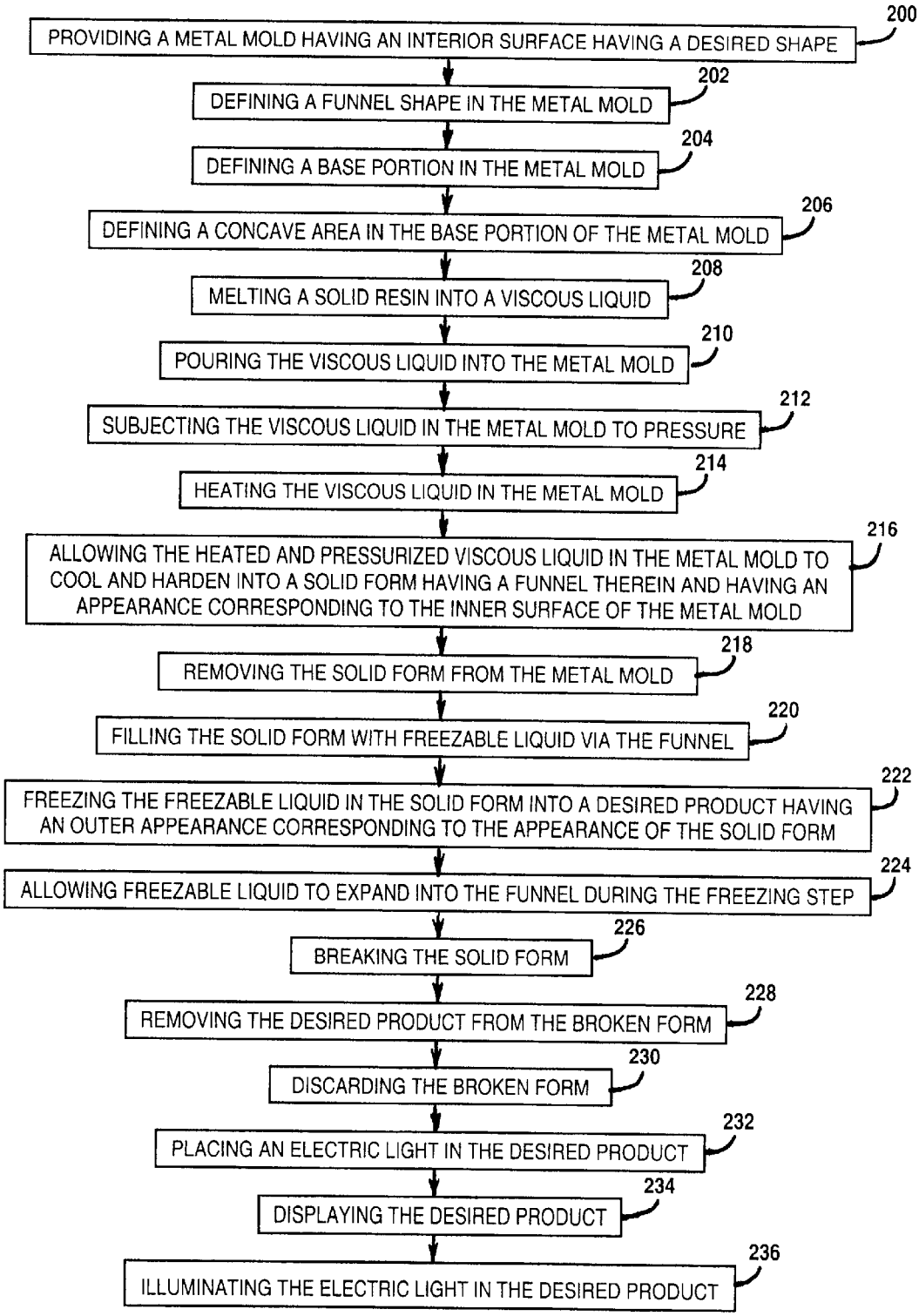
FIG. 4 is a flow chart showing the method steps embodying the present invention.

Referring to FIGS. 1, 2 and 3, it can be understood that a FIG. 10, such as a Santa Claus figure, formed according to the method of the present invention, includes a base 12 having a top surface 14, a bottom surface 16 and a side wall 18. A concave indentation 20 is defined in bottom surface 16 for a purpose that will be understood from the following disclosure. The remainder of the bottom 16 of the base 12 is planar so the base 12 can rest on a supporting surface. A desired FIG. 22 is supported on the top surface 14 of the base 12 and extends upwardly therefrom. The desired FIG. 14 includes detailed features, such as a beard 24, shoes 26, or the like.

Desired FIG. 10 is formed of ice, and thus water is poured into a mold to make desired FIG. 10. A funnel 30 is indicated in FIG. 1 to show how the liquid is poured into a mold. Funnel 30 is located in a temporary mold formed according to the teaching of the present invention. The funnel 30 provides a volume into which water can move during a freezing process. Other freezable fluids, such as gels, can be used without departing from the scope of the present invention.

An insert 40 is shown in FIG. 2. Insert 40 includes a dome-shaped cover 42 and an annular base 44 having a top surface 46 and a bottom surface 48. The dome shaped cover 42 is accommodated in concave indentation 20 with top surface 46 of the base abutting the bottom surface 16 of the base 12. An annular cutout can surround indentation 20 so base 44 will be received in the base 12 and bottom surface 48 will be planar with bottom surface 16 of the base 12. This will add stability to the overall desired figure.

An electric light unit 50 is shown in FIG. 3 and includes a light bulb 52 that is secured to a base 54 with a dome-shaped cover 56 there over. Base 54 includes circuitry to electrically connect bulb 52 to a suitable power source via cable 58. Dome 56 is sized and shaped to be snugly accommodated in dome-shaped cover 42 of insert 40 whereby the electric light bulb 52 will direct light upwardly into the desired figure. The circuitry in base 54 can include timers, and the like as well as circuitry that permits the light to flash on and off. Such circuitry is known to those skilled in the art and thus will not be discussed.

The figure for display is formed according to the following method. The method of the present invention comprises providing a metal mold having an interior surface having a desired shape in step 200. The metal mold will have an interior surface that is shaped to correspond to the desired outer surface of the figure, such as a negative of the outer surface shown in FIG. 1. A funnel shape is defined in the metal mold in step. 202; a base portion corresponding to base 12 is defined in the metal mold in step 204. A concave area corresponding to concave indentation 20 is defined in the base portion of the metal mold in step 206. A solid resin is melted into a viscous liquid in step 208 and the viscous liquid is poured into the metal mold in step 210. The viscous liquid is pressurized in the metal mold in step 212, and is heated in the metal mold in step 214. Once the liquid is at the desired consistency, the heated and pressurized viscous liquid in the metal mold is allowed to cool and harden into a solid form having a funnel therein and having an appearance corresponding to the interior surface of the metal mold in step 216. The solid form is a plastic or rubberlike mold and has an interior surface that is a negative of the outer surface shown in FIG. 1. The metal mold can be re-used whereas the plastic or rubberlike mold is a temporary mold. The temporary mold is sold to a customer while a manufacturer retains the metal mold.

The solid form is removed from the metal mold in step 218. When a figure is desired, the solid form is filled with freezable liquid via the funnel in step 220. The freezable liquid in the solid form is then frozen and forms into a desired product having an outer appearance corresponding to the appearance of the solid form in step 222. The freezable liquid is, allowed to expand into the funnel during the freezing step in step 224. The solid form is then broken in step 226 and the desired product is removed from the broken form in step 228. The broken form is discarded in step 230.

An electric light is placed in the desired product in step 232 and the desired product is displayed in step 234. The electric light in the desired product is illuminated in step 236.

The desired product can be the Santa Claus figure shown in FIG. 1, and the base portion of the mold will define the base shown for the figure. The concave area defined in the base portion will accommodate the insert shown in FIG. 2 and the electric light shown in FIG. 3 will be accommodated in the insert in the base of the figure. This will allow light to shine up through the figure thereby enhancing the display. Various colors of light can be used to further enhance the display as well as flashing lights. The freezable liquid used is generally water, but other gels can be used without departing from the scope of the present disclosure.

It is also noted that the exact details of the metal mold and the exact details of the temporary mold are not provided because those skilled in the molding art will understand what type of mold is required and its details based on the teaching of the present disclosure.

It is understood that while certain forms of the present invention have been illustrated and described herein, it is not to be limited to the specific forms or arrangements of parts described and shown.

What is claimed and desired to be covered by Letters Patent is:

1. A method of making an ice sculpture comprising:

a) providing a metal mold having an interior surface having a desired shape;

b) defining a funnel shape in the metal mold;

c) defining a base portion in the metal mold;

d) defining a concave area in the base portion of the metal mold;

e) melting a solid resin into a viscous liquid;

f) pouring the viscous liquid into the metal mold;

g) subjecting the viscous liquid in the metal mold to pressure;

h) heating the viscous liquid in the metal mold;

i) allowing the heated and pressurized viscous liquid in the metal mold to cool and harden into a solid form having a funnel therein and having an appearance corresponding to the interior surface of the metal mold;

j) removing the solid form from the metal mold;

k) filling the solid form with freezable liquid via the funnel;

l) freezing the freezable liquid in the solid form into a desired product having an outer appearance corresponding to the appearance of the solid form;

m) allowing freezable liquid to expand into the funnel during said freezing step;

n) breaking the solid form;

o) removing the desired product from the broken form;

p) discarding the broken form;

q) placing an electric light in the desired product;

r) displaying the desired product; and s) illuminating the electric light in the desired product.

2. The method as described in claim 1 wherein the freezable liquid is water.

3. The method as described in claim 2 wherein the desired product is a Santa Claus figure.

* * * * *